US009409315B1

(12) United States Patent
Bourget

(10) Patent No.: US 9,409,315 B1
(45) Date of Patent: Aug. 9, 2016

(54) CONCRETE POWER SAW

(71) Applicant: Kyle Bourget, Augusta, KS (US)

(72) Inventor: Kyle Bourget, Augusta, KS (US)

( * ) Notice: Subject to any disclaimer, the term of this patent is extended or adjusted under 35 U.S.C. 154(b) by 0 days.

(21) Appl. No.: 15/151,291

(22) Filed: May 10, 2016

Related U.S. Application Data

(63) Continuation-in-part of application No. 14/715,209, filed on May 18, 2015.

(51) Int. Cl.
*B28D 7/02* (2006.01)
*B28D 1/04* (2006.01)

(52) U.S. Cl.
CPC . *B28D 7/02* (2013.01); *B28D 1/045* (2013.01)

(58) Field of Classification Search
CPC ..... B28D 7/02; B28D 1/045
See application file for complete search history.

(56) References Cited

U.S. PATENT DOCUMENTS

| | | | | |
|---|---|---|---|---|
| 1,495,430 | A * | 5/1924 | Parker | B23D 45/024 125/14 |
| 4,241,505 | A | 12/1980 | Bodycomb, Jr. et al. | |
| 4,253,362 | A | 3/1981 | Olson | |
| 4,255,995 | A | 3/1981 | Connor | |
| 4,326,864 | A | 4/1982 | Sittler | |
| 6,318,352 | B1 | 11/2001 | Gnazzo et al. | |
| 6,557,261 | B1 | 5/2003 | Buser et al. | |
| 6,748,660 | B2 | 6/2004 | Buser et al. | |
| 6,925,919 | B2 | 8/2005 | Liao et al. | |
| 7,013,884 | B2 | 3/2006 | Guth | |
| 7,246,406 | B2 | 7/2007 | Yarbrough et al. | |
| 7,654,181 | B2 | 2/2010 | Quinlan | |
| 7,802,505 | B2 | 9/2010 | Hetcher et al. | |
| 7,824,247 | B1 | 11/2010 | Bar-Cohen et al. | |
| 8,381,711 | B2 | 2/2013 | Loveless | |
| 8,650,997 | B1 | 2/2014 | Simon | |
| 8,752,462 | B2 | 6/2014 | Frolov | |
| 8,857,421 | B2 | 10/2014 | Kondo et al. | |
| 2006/0060179 | A1 * | 3/2006 | Kingsley | B23D 47/12 125/13.01 |
| 2006/0191526 | A1 * | 8/2006 | Markley | B23D 47/02 125/13.01 |
| 2006/0272464 | A1 | 12/2006 | Chen | |
| 2007/0164599 | A1 * | 7/2007 | Johnson | E01C 23/0933 299/39.6 |
| 2009/0236900 | A1 | 9/2009 | Due et al. | |
| 2010/0269353 | A1 | 10/2010 | Martin | |
| 2015/0013513 | A1 | 1/2015 | Merck et al. | |
| 2015/0246461 | A1 | 9/2015 | Bourget | |

FOREIGN PATENT DOCUMENTS

| | | |
|---|---|---|
| WO | WO2006031236 | 3/2006 |

* cited by examiner

*Primary Examiner* — Joseph J Hail
*Assistant Examiner* — Marc Carlson
(74) *Attorney, Agent, or Firm* — Kenneth H. Jack; Davis & Jack, L.L.C.

(57) ABSTRACT

A concrete saw for cutting a concrete slab incorporating a rollable trolley having upper, lateral, front, and rear ends; an engine fixedly attached to the rollable trolley, the engine having a rotary power output; a blade connected operatively to the engine's rotary power output for, upon movement of the first rollable trolley over the concrete slab, slotting said slab and drawing concrete cuttings therefrom; a shroud fixedly attached to the first rollable trolley, the shroud having a plurality of side walls, a floor, and a ceiling, the shroud housing the blade, and defining a dust containment space; a dust conveyor having input and output ends, the dust conveyor's input end being positioned within the shroud's dust containment space; power transfer pulleys connected operatively to the dust conveyor for conveying the concrete cuttings from the dust conveyor's input end to the output end; and a receptacle under the output end.

18 Claims, 5 Drawing Sheets

CONCRETE POWER SAW

CONTINUATION IN PART STATUS OF APPLICATION

Reference is made to U.S. patent application Ser. No. 14/715,209, entitled "Concrete Power Saw", and filed May 18, 2015. The instant application constitutes a continuation in part of said '209 application.—The inventor of and applicant of said '209 application and the instant application are the same, and the instant application is filed prior to any issuance or abandonment of said '209 application. Said '209 application shall remain co-pending with the instant application, and the benefit of and priority of said '209 application is hereby claimed.

FIELD OF THE INVENTION

This invention relates to power saws which typically rotatably drive industrial grade diamond impregnated blades, such saws being adapted for cutting slots into concrete slab surfaces. More particularly, this invention relates to such saws which are adapted for collecting and handling emanations of concrete dust and cuttings during slot cutting operations.

BACKGROUND OF THE INVENTION

Conventional gasoline or electric motor driven concrete power saws are conventionally used for cutting slots or contraction joints within concrete slabs, such as concrete roadways, sidewalks, foundation floors, and tarmacs. During such cutting operations, concrete dust cuttings commonly and undesirably emanate from the cutting site to cover surfaces and foul the air. A primary component of concrete dust is silica, and breathing of such dust is known to contribute to onset of silicosis of the lungs. Due to concrete's common coal or fly ash content, concrete dust cuttings may also include toxic heavy metals and metalloids such as lead and arsenic. In addition to the harmful health effects of concrete dust, such dust is often difficult and time consuming to clean from floor surfaces and other surfaces such as vehicles and building fixtures and walls.

Known vacuum based systems for handling and reducing such concrete dust are undesirably mechanically complex and cumbersome, and are not economically provided.

The instant inventive concrete power saw solves or ameliorates the problems, defects, and deficiencies discussed above by providing specialized concrete dust capturing and conveying mechanisms which effectively reduce emanations of concrete dust without the provision of any vacuum actuated system or equipment.

BRIEF SUMMARY OF THE INVENTION

A first structural component of the instant inventive concrete saw comprises a rollable trolley. In a preferred embodiment, the rollable trolley comprises a rigid and substantially rectangular plate steel deck having a pair of fixed rear wheels, and having at least a first adjustable height front wheel. The adjustability of the trolley's front wheels facilitates adjustability of the cutting depth of the concrete saw machine and alternatively facilitates maintenance of a constant cutting depth as diameters of rotary blades vary.

A further structural component of the instant inventive concrete saw comprises motor means which are fixedly attached to the rollable trolley. In the preferred embodiment, the motor means are mounted directly upon an upper surface of the rollable trolley, the motor means utilizing the trolley as a support pedestal.

In a preferred embodiment, the motor means comprise a four cycle air cooled gasoline engine. Suitably, the motor means may alternatively comprise a two cycle engine. Also suitably, the motor means may further alternatively comprise an electric motor. For indoor operation, the motor means may suitably comprise a propane gas powered internal combustion engine. The motor means necessarily has a rotary power output which is at least utilized for rotatably driving the machine's saw blade. The motor means preferably further drives via provided secondary turning means the machine's below described dust conveying apparatus.

A further structural component of the inventive concrete saw comprises a rotary concrete cutting blade. Preferably, the blade is of the type having impregnated industrial grade diamonds for longevity in concrete cutting use. In a preferred embodiment, the blade component is connected operatively to the motor means' rotary power output by a journal axle, belt, and pulleys combination, such combination positioning the blade for cutting impingement against underlying concrete slab surfaces.

A further structural component of the instant inventive concrete saw comprises a specially configured blade shroud which is preferably fixedly and rigidly mounted to a lateral side of the rollable trolley. The rigid mount of the shroud in combination with a rigid journal axle mount of the blade to the shroud and/or the trolley advantageously requires that blade positioning and movement be coincident with trolley positioning and movement.

In the preferred embodiment, the machine's shroud component has a plurality of side walls (preferably consisting of a lateral wall, an oppositely lateral wall, a front wall, a rear wall), a ceiling, and a floor. Preferably, the floor component comprises a slide plate which is adapted for dynamic vertical adjustment and movement. In the preferred embodiment, the combination of such shroud walls, ceiling, and floor forms, defines, and encloses a dust containment space which functions as a first stage handling space for minimization of emanations of concrete dust during concrete saw cutting.

A further structural component of the instant inventive concrete saw comprises rotary power driven dust conveyor having dust input and dust output ends. In a preferred embodiment such conveyor comprises an Archimedes' screw which operates similarly with a tube mounted helical blade auger for conveyance of granular materials. Where the invention's conveyor component comprises an Archimedes' screw, such component preferably comprises a hollow tube which receives and rotatably houses a helically bladed bit or screw. In the preferred embodiment, the lower and forward input end of the Archimedes' screw is configured integrally with the blade shroud so that the Archimedes' screw is forwardly supported and so that its input end resides within the shroud's dust containment space.

Alternatively, the rotary power driven dust conveyor component may comprise a rectangular tube mounted continuous loop dust conveyor whose input end resides within the interior space of the dust shroud. Where such alternative conveyor is provided, its continuous loop belt preferably has fixedly attached and outwardly extending cleats or dust carrying vanes which function similarly with the helical flight of the Archimedes' screw.

Further structural components of the instant inventive concrete saw comprise the secondary turning means. Where the preferred Archimedes' screw conveyor is provided, the secondary turning means are preferably connected operatively to the opposite output end of the Archimedes' screw component, such opposite end preferably being positioned upwardly and rearwardly from the shroud. Where the continuous loop conveyor alternative is provided, the secondary turning means are preferably alternatively connected operatively to a laterally extending belt driving roller at the opposite output end of the conveyor component. Like the Archimedes' screw, such conveyor opposite end is preferably positioned upwardly and rearwardly from the shroud.

Suitably, the turning means may comprise a secondary and separate electric motor or internal combustion engine whose rotary power linkage is connected to the output end of the Archimedes screw's helical bit or conveyor drive roller, as the case may be. However, in the preferred embodiment, the turning means derives its rotary power from the rotary power output of the machine's primary motor means. Where the Archimedes' screw is provided, a drive linkage comprising a second belt and pulleys combination in further combination with a rotational power redirecting gear train is provided for rotatably driving the Archimedes' screw. In the alternative belt conveyor configuration, the axes of rotation of the belt's rollers are advantageously parallel with the motor's drive output. Accordingly, the instant invention advantageously allows a single engine to simultaneously rotatably drive the machine's blade (which generates the concrete dust) and drives the machine's conveyor (either an Archimedes' screw or a belt conveyor) which conveys the concrete dust.

A further component of the instant inventive concrete saw comprises a receptacle for the receiving concrete saw cuttings. In the preferred embodiment, the receptacle comprises a bin which rolls upon and is supported by a second rollable trolley, such trolley moving in train with the first rollable trolley. Preferably, the output end of the Archimedes' screw or belt conveyor (as the case may be) is equipped with an output chute which is downwardly directed for communication with an upper opening of the receptacle.

In operation of the instant inventive concrete saw, the Archimedes' screw or belt conveyor preferably continually turns during concrete sawing operations. Concrete dust and cuttings, which are continuously drawn and thrown by the rotary blade from the sawn slot and into the shroud's dust containment space, advantageously fall into or are directed into the Archimedes' screw's or belt conveyor's input end. Continuous rotation of the Archimedes' screw's helical screw flights (or continuous upward and rearward movement of the cleats of the upper flight of the alternatively provided belt conveyor) carries such saw cuttings upwardly and rearwardly along the tube to emit into the chute, and to fall downwardly therethrough into the trailing receptacle.

As a result of operation of the inventive saw, dust emanations at and about the slot cutting site are minimized with the majority of the concrete cuttings being conveyed into and stored within the receptacle for proper disposal.

Accordingly, objects of the instant invention include the provision of a concrete cutting saw which incorporates structures, as described above, and which arranges those structures in relation to each other, in manners described above, for achievement of the beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
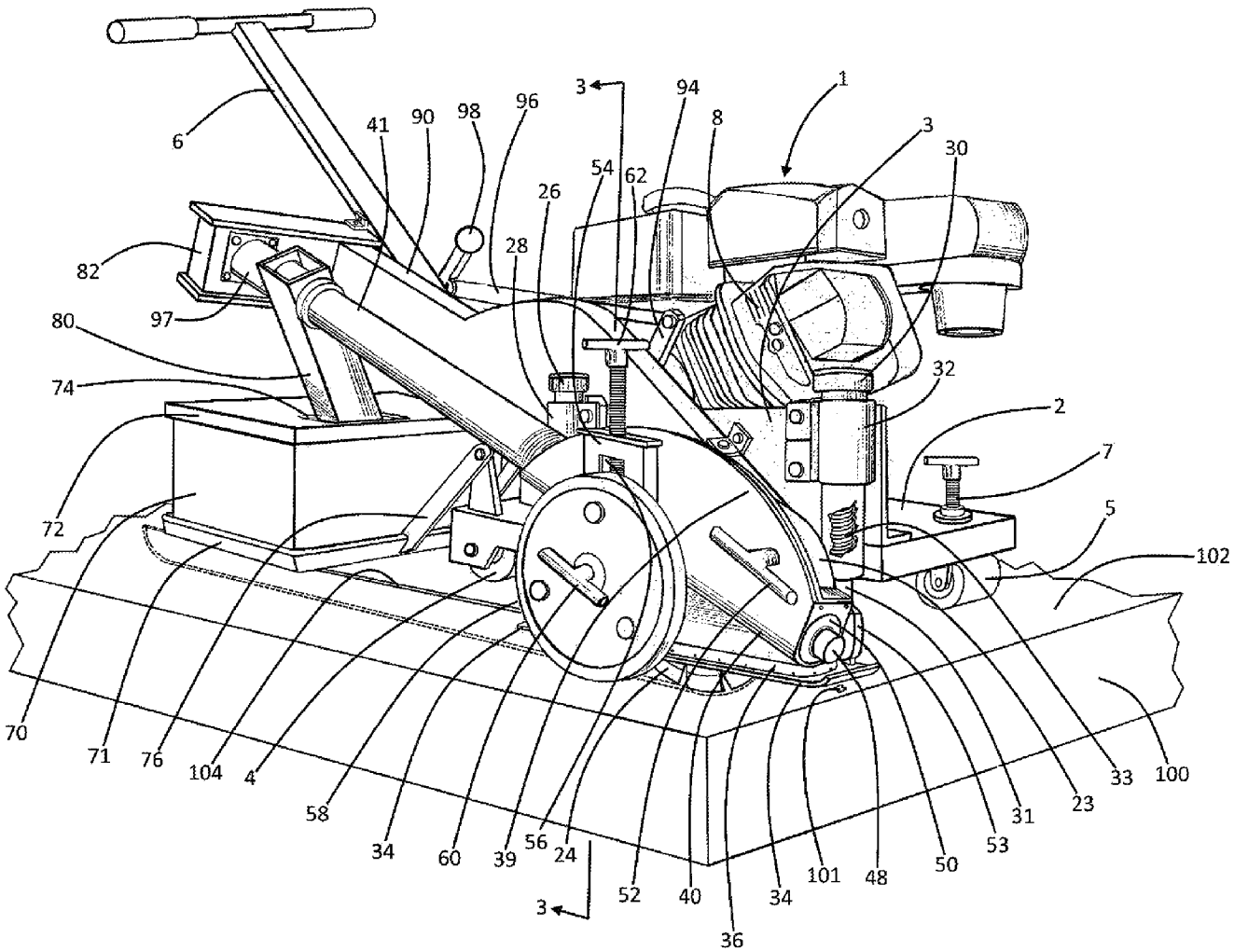
FIG. 1 is a perspective view of a preferred embodiment of the instant inventive concrete saw.

Referring now to the drawings and in particular to Drawing FIG. 1, a preferred embodiment of the instant inventive concrete saw is referred to generally by Reference Arrow 1. The saw 1 preferably comprises a first trolley 2 having a pair of rear wheels 4, and at least a first front wheel 5. In the preferred embodiment, the front wheel 5 is equipped with a height adjustment screw 7 for selective adjustment of the elevation of the front edge of the first trolley 2 with respect to the upper surface of a concrete slab 100, such height adjustment enabling alterations and maintenance of the saw's cutting depth in a manner discussed below.

Referring further to FIG. 1, a gasoline powered internal combustion engine 8 is securely mounted to the upper surface of the deck of the rollable trolley 2. Such engine 8 is intended as being representative of other suitable motor means such as electric motors which are considered to fall within the scope of the invention.

Figure 2:
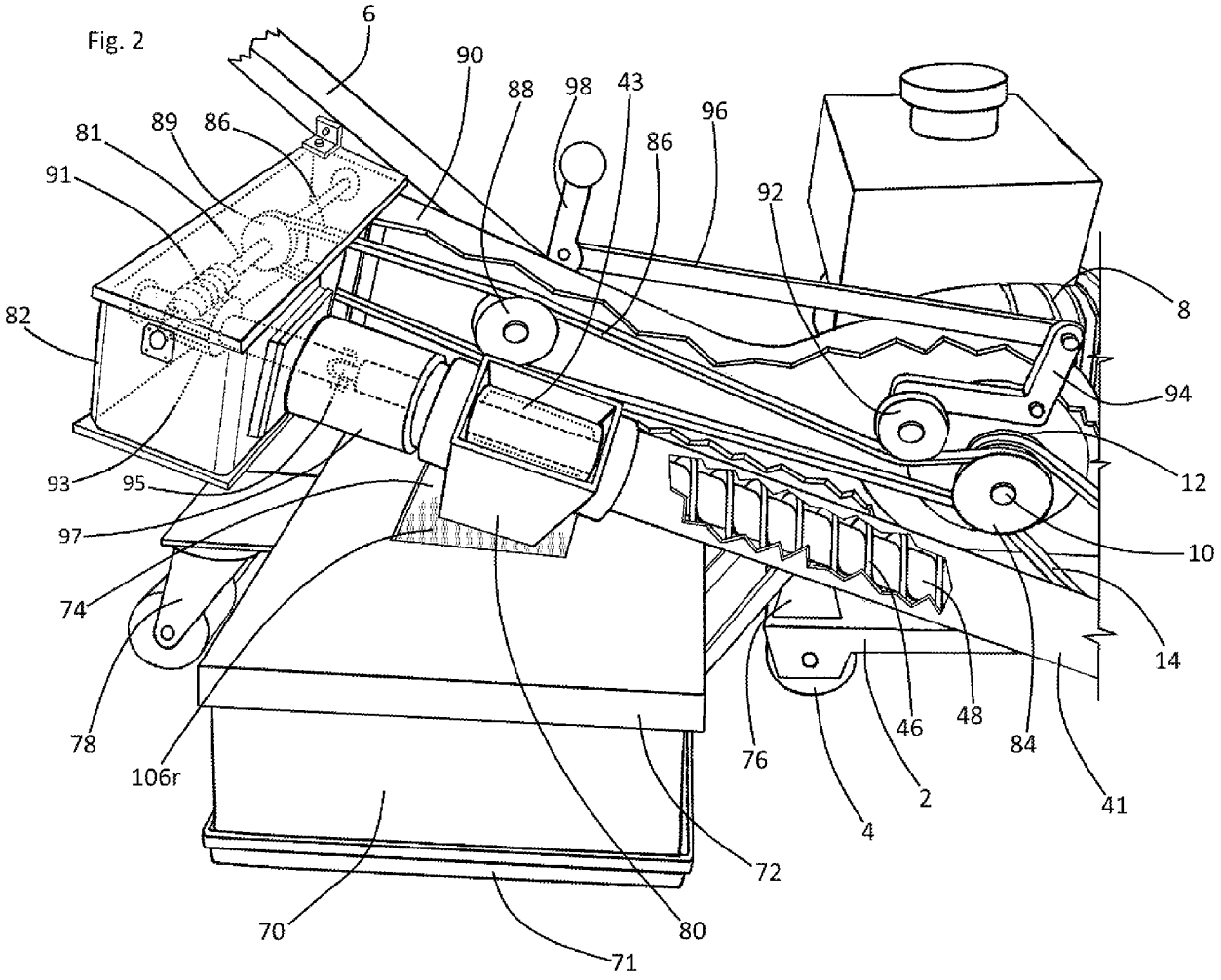
FIG. 2 redepicts in magnified view a portion of the structure presented in FIG. 1, the view of FIG. 2 including cutaway sections and dashed line structures in explanation of internal mechanical components.
Figure 3:
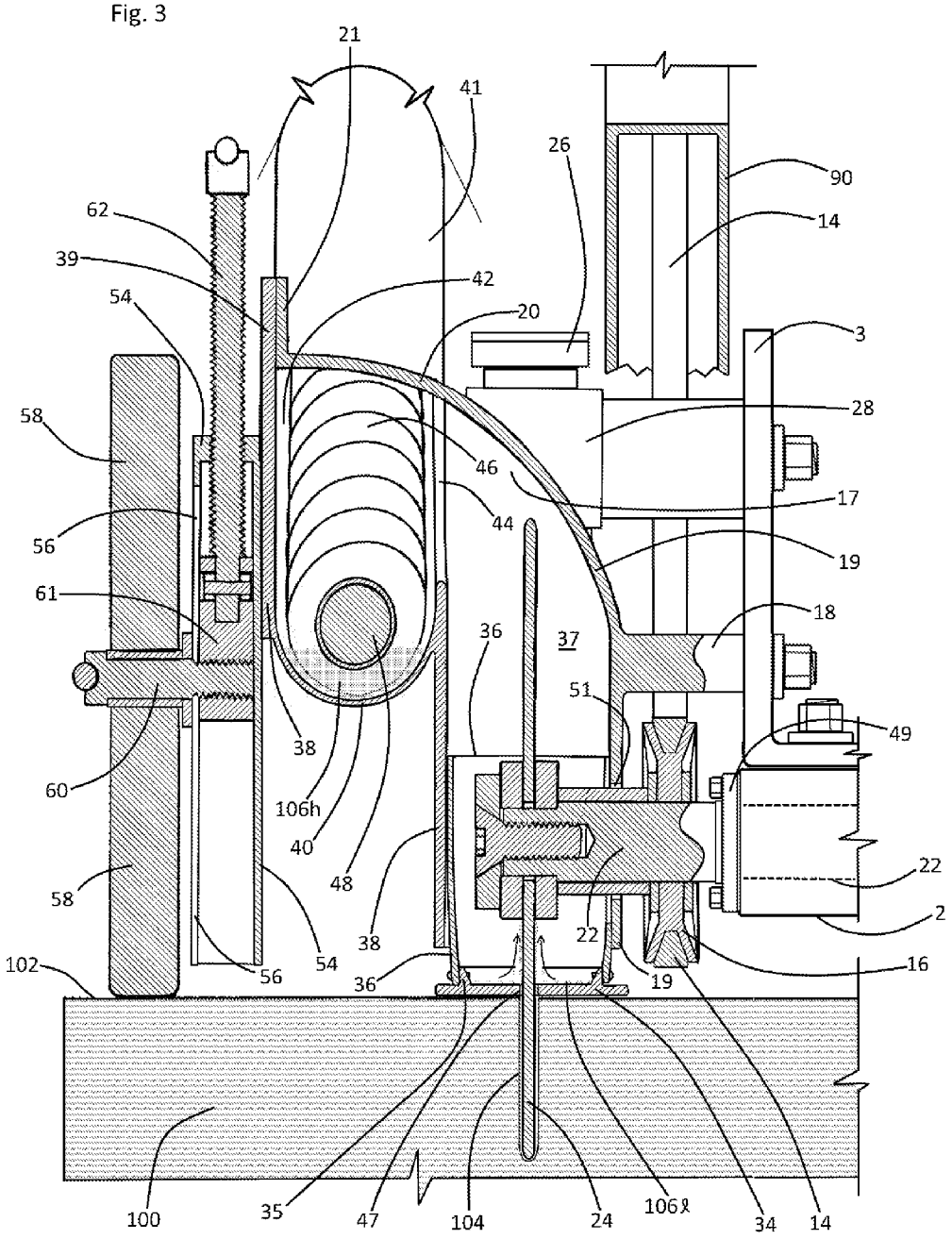
FIG. 3 is a partial sectional view as indicated in FIG. 1.

Referring simultaneously to FIGS. 1-3, a concrete cutting blade 24 is connected operatively to the rotary drive output 10 of the engine 8. The blade 24 is rotatably mounted by means of a journal axle 22 which extends through an aperture 51 within a left or oppositely lateral shroud wall 19, which itself is rigidly connected to the trolley 2 by means of "L" flange 3 and connector arm 18. The oppositely lateral end of axle 22 is rotatably supported upon the lateral end of trolley 2 by rotary bearing 49. A pulleys 12 and 16, and belt 14 combination, translates rotary power from the engine's rotary output 10 to the axle 22 and to the blade 24.

Referring simultaneously to FIGS. 1 and 3, the blade shroud has a lateral side wall 38, an oppositely lateral side wall 19, a ceiling 20, a back wall 17, a front wall 23, and a slide plate configured floor 34. Such combination of walls 38,19,17,23, ceiling 20, and floor 34 advantageously forms and defines a dust containment space 37. In a preferred embodiment, the ceiling 20 is arcuately curved so that concrete dust 106*l* which is thrown and churned within the containment space 37 is directed upwardly and laterally through port 44 for handling and conveyance in the manner described below.

A rotary power driven dust conveyor in the form of an Archimedes' screw is preferably provided, as indicated in FIGS. 1-3. The Archimedes' screw component preferably comprises a hollow tube 41, a drive axle 48, and a helical screw flight 46. A lower intake end of the Archimedes' screw 41,46,48 is preferably positioned at and opens into the shroud's interior dust containment space 37. In the preferred embodiment, the shroud's lateral wall 38 is laterally stepped or offset at an elevation above the slide plate floor 34 and below the ceiling 20, such offset advantageously forming a dust collecting land 40.

In the preferred Archimedes' screw actuated embodiment, the shroud's dust collecting land 40 is concavely configured to present a cylindrical curvature which is closely fitted for nesting receipt of the cylindrical periphery of the helical blade flights 46. Also in such preferred embodiment, the forward end of the Archimedes' screw's drive axle 48 is supported by a rotary bearing 50 which is mounted to the shroud's front wall 23, such bearing 50 effectively closing the forward end of the tube 40,41.

The shroud 38,20,19,23,34 is preferably longitudinally seamed to divide the shroud into separable lateral and oppositely lateral "clamshell" segments. In the preferred embodiment, the lateral segment includes the lateral wall 38, the curved dust collecting land 40, and the rotary bearing 50, the input end of the Archimedes' screw component preferably being integral with such lateral shroud segment. The oppositely lateral segment of the shroud preferably comprises the lateral wall 19 in combination with the curved ceiling 20. Hand turnable attachment screws 52 which extend through mounting flanges 39 and 21 are preferably provided for removably connecting the shroud's lateral and oppositely lateral segments. Such "clamshell" mode of connection of the shroud's segments facilitates easy access to the blade 24 for mechanical maintenance.

Referring in particular to FIG. 2, the rearward end of the Archimedes' screw preferably includes an output port 43 (shown as a dotted line) which opens tube 41. An output chute 80 communicates with such port 43 for directing the concrete cuttings and dust output of the Archimedes' screw through an upper port 74 of a rearwardly trailing concrete dust receptacle 70.

The rearward end of the axle 48 of the Archimedes' screw is preferably rotatably driven by turning means, preferably in the form of a belt 86 and pulleys 84,88,89 combination. Such belt and pulleys combination translates rotary power from the engine's rotary power output 10 to a transverse axle 81 which is rotatably mounted within a power transfer box 82. The transverse axle 81 rotatably drives a worm gear 91 which engages and turns a pinion gear 93 which is axially joined with the Archimedes' screw's drive axle 48. A universal joint 95 advantageously accommodates for angular deflections of the Archimedes' screw with respect to the power transfer box 82. The universal joint 95 further facilitates disassembly and disconnection of the clamshell halves of the shroud without requiring disconnection of the drive shaft 48. A flexible boot 97 is provided to facilitate such clamshell disconnection. A belt and pulley shroud 90 is preferably provided for protecting operators from pinch points inherent in such power transfer system.

The Archimedes' screw's turning means preferably incorporates a tensioning pulley 92 mounted upon a pivot arm 94. Such tensioning pulley 92 may be actuated by hand manipulation of lever 98 which rotates the pivot arm 94 via a bar linkage 96. Rearward pivoting of lever 98 engages the turning means by tightening the belt 86 against drive pulleys 89 and 84. Forward deflection of lever 98 raises the tensioning pulley 92, causing the belt 86 to slacken to allow continued rotary motion of the rotary power output 10 while the axle 48 and its screw flights 46 remain motionless. Pulley 88 constitutes an idler pulley which continues to guide belt 86 while such belt is frictionally disengaged.

While the mechanical combination of the belt 86, pulleys 89, 88, 92, and 84, transverse axle 81, worm gear 91, and pinion gear 93 constitutes a preferred means for turning the Archimedes' screw axle 48, other turning means such as an independent electric motor or an independent internal combustion engine are considered to fall within the scope of the invention. Other variously configured and commonly known rotary power redirecting drive trains, such as bevel gear and drive axle combinations, are also considered to fall within the scope of the invention. The depicted belt, pulleys, and gears turning means combination is intended as being representative of such alternative turning means.

Referring simultaneously to FIGS. 1 and 2, a height adjustable lateral wheel 58 is preferably provided, such wheel 58 being rotatably mounted upon a journal axle 60 whose lateral end is configured as a hand turnable "T" for operator assembly and disassembly. The oppositely lateral end of the journal axle 60 is preferably helically threaded for removably engaging a slide block 61. Block 61 is preferably slidably received within a slide mount 54 which exposes the block 61 and axle 60 beneath a vertical slide slot 56. Clockwise and counterclockwise turning of jack screw 62 selectively raises and lowers the wheel 58. In a preferred mode of operation, screws 62 and 7 are turned in a coordinated fashion so that the lower ends of wheels 58 and 6 reside at a common elevation with respect to the deck of trolley 2. Such coordination of adjustable heights maintains blade 24 at a perpendicular orientation with respect to the upper surface 102 of the concrete slab 100 while allowing the machine's operator to precisely control the depth of a concrete slot 104 which is cut by blade 24. As the diameter of blade 24 varies due to wear, such coordinated manipulation of screws 62 and 7 may assure slot depth consistency during prolonged usage of the machine 1.

Referring further simultaneously to FIGS. 1 and 2, the slide plate configured floor 34 has a blade slot 47. The shroud is preferably specially adapted for alternative upward and downward telescoping motion of the plate 34 and slot 47 with respect to the lower ends of the side walls 38 and 19, rear wall 17, and front wall 23 of the shroud. In order to facilitate such telescoping motion, an upwardly extending elastomeric flange 36 is preferably attached to the slide plate 34, such flange's lower end being fixedly attached to a peripherally extending mounting ridge 35. In the preferred embodiment, the elastomeric flange 36 is closely fitted to the inner dimensions of the walls 38, 19, 17, and 23 so that concrete dust 106*l* does not escape between the peripheral seam formed between such flange and such walls.

The telescoping means which facilitate the upward and downward motions of the slide plate 34 preferably further comprise front and rear spring biased quill and shaft combinations 26 and 30, such quill and shaft combinations being rigidly mounted to the first trolley 2 by means of the rigidly mounted "L" flange 3 and rigid oppositely laterally extending bracket arms 28 and 32. Springs 33 which co-axially receive shafts 31 within the quill portions of the quill and shaft combinations 26 and 30 advantageously allow the lower ends of such shafts 31 to float upwardly and downwardly in a spring damped and normally downwardly extended fashion. Such shaft lower ends are preferably pivotally attached to the oppositely lateral edge of slide plate 34 by front and rear pivot mounts 53 (the rear pivot mount not being within views).

In operation of the above described slide plate telescoping means, a pebble 101, for example, may reside on the slab surface 102 in front of slide plate 34. Pebble 101 is intended as being representative of small changes or fluctuations in the grade or surface texture of the concrete surface 102. Upon contact of the forward end of the slide plate 34 with the pebble 101, the front end of the slide plate 34 deflects upwardly, driving shaft 31 upwardly against spring 30. Simultaneously, the sealing flange 36 slidably moves against the interior surfaces of the shroud's side walls without any breakage or interruption of the flange's dust sealing function. Continued forward passage of the slide plate 34 over pebble 101 allows the front end of the slide plate 34 to normally counter-deflect downwardly (through the action of the front quill and shaft combination 30) while the rearward end of the slide plate 34 in succession deflects upwardly (through the action of the rear quill and shaft combination 26). Accordingly, the telescoping means associated with the slide plate 34 advantageously allow the machine and the slide plate 34 to move over small concrete surface irregularities and protuberances, such as pebble 101, while continuously performing dust containment and sealing, and without any gross disturbance or variation of the cutting depth of the blade 24.

Referring simultaneously to FIGS. 1 and 2, to effectively collect and temporarily store concrete dust cuttings, the receptacle 70 having a removable lid 72 is preferably mounted upon and carried by a second rollable trolley 71. Such second trolley is preferably rearwardly supported by a rear caster wheel 78, and is forwardly supported and towed by bracket arms 76 which securely and pivotally interconnect the second trolley 71 with the first trolley 2.

Referring simultaneously to FIGS. 1-3, the machine's operator may, for example, desire to cut a one inch depth expansion slot 104 within a concrete slab 100. Accordingly, the operator may turn "T" handle screws 62 and 7 until the lower ends of wheels 58 and 5 upwardly retract to the elevation which overlies that of the lower end of blade 24 by one inch. Thereafter, engine 8 may be actuated, and lever 98 may be pulled rearwardly, causing the Archimedes' screw turning belt 86 to frictionally engage and rotatably drive the helical bit 46 and axle 48 within tube 41. Upon lowering of the blade 24 into the surface 102 of the concrete slab 100, the blade 24 draws and throws (in the upward direction indicated by the arrows drawn upon FIG. 3) concrete dust and cuttings **106*l* into the interior space 37 of the shroud. Continued rotary motion of the blade 24 minimizes accumulations of concrete dust 106*l* upon floor 34, such blade continually churning and rapidly throwing the dust within and about such space. Such rotary motion and dust throwing effect causes portions of the dust to continuously impinge against the curved ceiling 20. The curved ceiling 20 advantageously causes the dust 106*l* to carom laterally through port 44 to fall laterally and downwardly over the curved dust capturing land 40 to accumulate therein as concrete dust 106*h***.

The continuous rotary turning of the screw flights 46 within the interior space 42 of the tube 41 draws such dust **106*h* upwardly and rearwardly through tube 41 to emit through outlet port 43, such dust immediately falling downwardly through chute 80 and into and through 72 of receptacle 70 to reside as collected dust 106*r*. As the slot cutting progresses along the slab 100**, such dust collection and Archimedes' screw actuated dust conveyance continues, advantageously preventing harmful emanations of concrete dust at and about the cutting site.

To assist an operator in guiding the machine 1 along the path of slot 104, a "T" handle 6 is preferably rigidly mounted to the rearward end of the rollable trolley 2.

Figure 4:
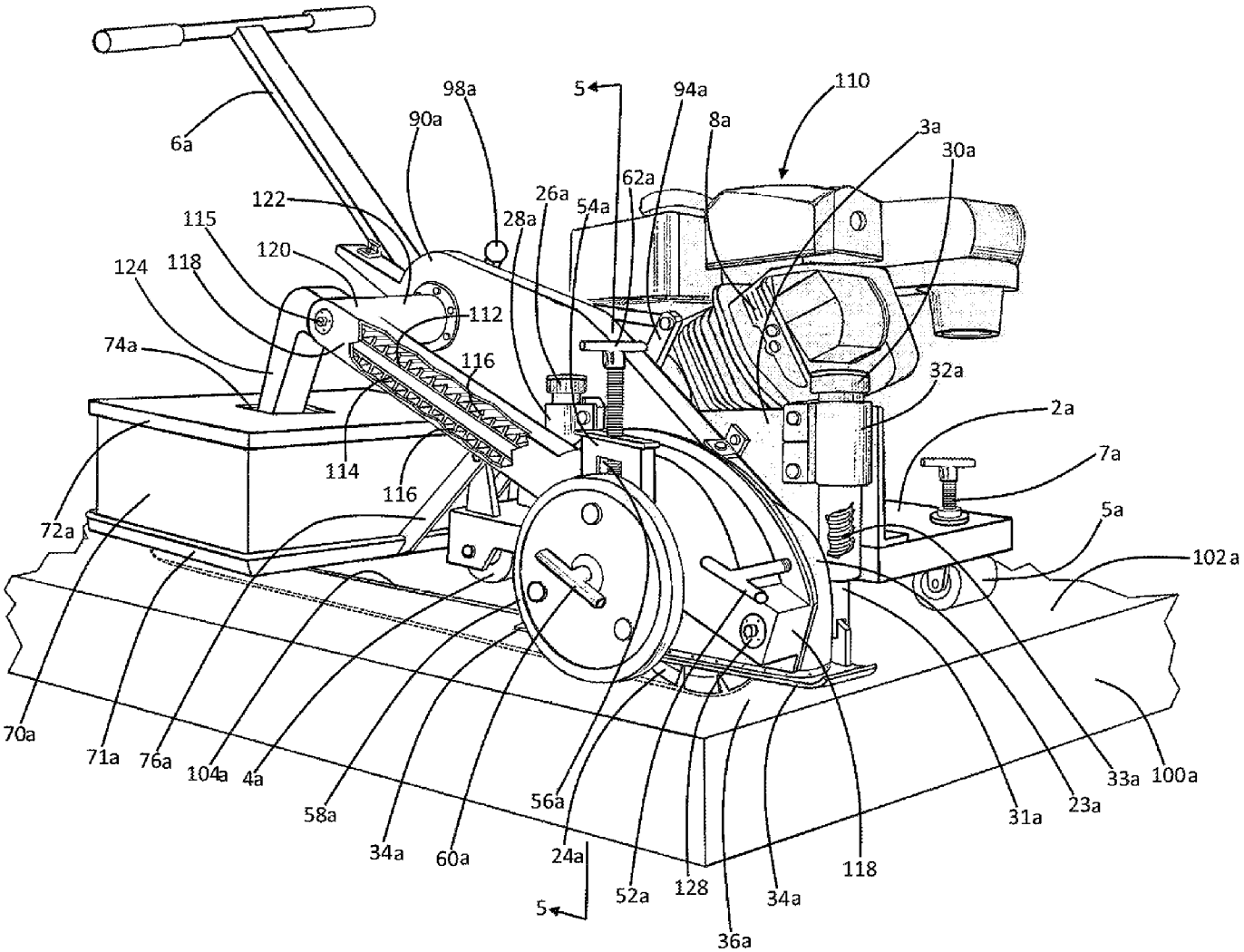
FIG. 4 presents an alternate configuration of the saw of FIG. 1
Figure 5:
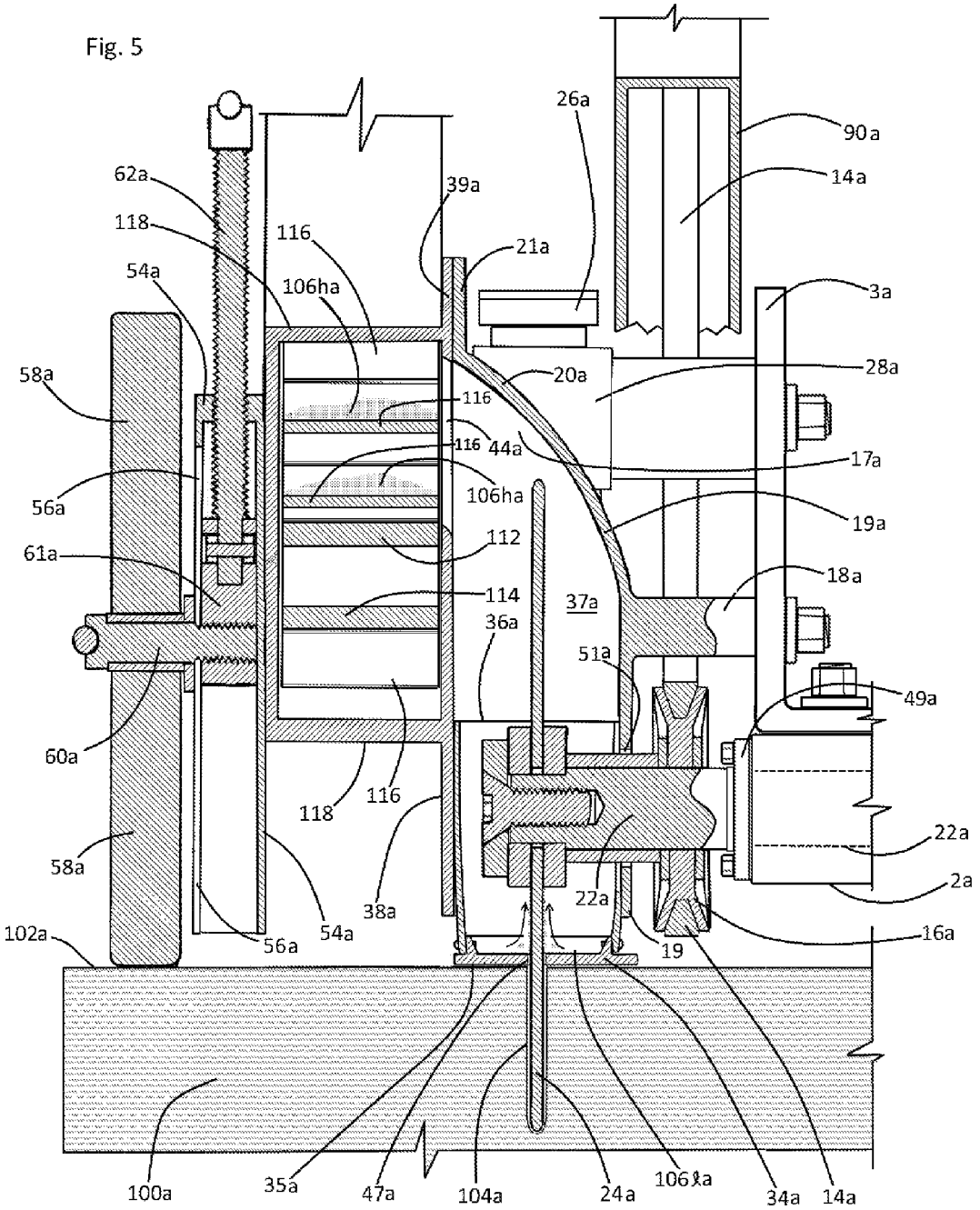
FIG. 5 is a partial sectional view as indicated in FIG. 4.

Referring to the alternative dust conveyor configuration 110 of drawing FIGS. 4 and 5, all structures which are identified by a reference numeral having the suffix "a" are substantially identical in form and function to similarly numbered structures appearing in FIGS. 1-3. A flexible continuous loop belt has upper flight 112 and a lower flight 114 and moves within rectangular tube 118. A multiplicity of cleats or dust carrying vanes 116 are fixedly attached to and extend perpendicularly from the upper and lower flights 112 and 114. A counter-clockwise turning rotary drive 115 extends laterally within axle housing 122, and turns a belt driving roller (not visible within views). At the opposite or lower forward end of the belt conveyor 112,114 and idler roller 128 is rotatably mounted. Rotary power supplied by the drive roller axle 115 continuously moves the cleats 116 of the upper flight 112 of the belt upwardly and rearwardly. Concrete dust **106*la* is thrown by blade 24*a* upwardly and laterally through conveyor intake port 44*a* in a manner similar to that described above. Such thrown concrete dust 106*ha* collects against the rearward faces of cleats 116 and upon the upper belt flight 112 for upward and rearward carriage. Upon reaching the conveyor's output end, such dust 106*ha* ejects downwardly from the conveyor's output end 120 through chute 124 and into bin 70*a***.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. A concrete saw for cutting a concrete slab, the concrete saw comprising:

(a) a first rollable trolley having upper, lateral, front, and rear ends;

(b) a motor fixedly attached to the first rollable trolley, the motor having a rotary power output;

(c) a blade connected operatively to the motor's rotary power output for, upon movement of the first rollable trolley over the concrete slab, slotting said slab and drawing concrete cuttings therefrom;

(d) a shroud fixedly attached to the first rollable trolley, the shroud having a plurality of side walls, a floor, and a ceiling, the shroud housing the blade and defining a dust containment space;

(e) a rotary drive actuated conveyor having input and output ends, the rotary drive actuated conveyor's input end being positioned within the shroud's dust containment space;

(f) a drive linkage connected operatively to the rotary drive actuated conveyor for conveying the concrete cuttings from said conveyor's input end to said conveyor's output end; and (g) a receptacle underlying the rotary drive actuated conveyor's output end.

2. The concrete saw of claim 1 wherein the rotary drive actuated conveyor comprises a continuous loop conveyor.

3. The concrete saw of claim 2 wherein the continuous loop conveyor comprises a flexible belt having a multiplicity of dust catching cleats.

4. The concrete saw of claim 3 wherein the shroud's side walls comprise a lateral wall and an oppositely lateral wall, the shroud's lateral wall forming an upwardly facing cuttings capturing land.

5. The concrete saw of claim 4 wherein the shroud's ceiling is arcuately curved.

6. The concrete saw of claim 5 wherein the continuous loop conveyor further comprises a lateral roller driving shaft positioned at said conveyor's output end and an idler roller positioned at said conveyor's input end.

7. The concrete saw of claim 6 further comprising a seam, the seam segmenting the shroud into lateral and oppositely lateral segments, and further comprising releasable fasteners, the releasable fasteners interconnecting the shroud's lateral and oppositely lateral segments.

8. The concrete saw of claim 7 wherein the drive linkage comprises a belt and pulleys combination, said combination being connected operatively to the motor's rotary power output.

9. The concrete saw of claim 8 wherein the shroud's floor comprises a slide plate having a slot, the blade being received within the slot.

10. The concrete saw of claim 9 further comprising a telescoping flange operatively interconnecting the shroud's slide plate and the shroud's side walls, the telescoping flange being adapted for facilitating alternative upward and downward movements of the slide plate with respect to the side walls.

11. The concrete saw of claim 10 wherein the telescoping flange comprises a cuttings sealing flange fixedly attached to and extending upwardly from the slide plate, the cuttings sealing flange being closely fitted for receipt between the shroud's side walls.

12. The concrete saw of claim 11 wherein the telescoping flange further comprises front and rear spring damped quill and shaft combinations, said combinations operatively interconnecting the shroud's slide plate and the first rollable trolley.

13. The concrete saw of claim 7 further comprising a lateral support wheel and a height adjustment mechanism, the height adjustment mechanism interconnecting the lateral support wheel and the shroud's lateral segment.

14. The concrete saw of claim 13 wherein the height adjustment mechanism is adapted for selectively upwardly and downwardly positioning the lateral support wheel with respect to the shroud.

15. The concrete saw of claim 14 wherein the height adjustment mechanism comprises a jack screw, slide slot, and slide block combination, and further comprise a journal axle, the journal axle being removably attached to said combination's slide block.

16. The concrete saw of claim 2 further comprising an output chute mounted to the continuous loop conveyor in communication with said conveyor's output end.

17. The concrete saw of claim 16 wherein the receptacle comprises a second rollable trolley, the second rollable trolley being fixedly attached to the rearward end of the first rollable trolley.

18. The concrete saw of claim 17 wherein the receptacle has an open upper end, wherein the chute has a lower end, and wherein the chute's lower end extends into the receptacle's open upper end.

* * * * *